US005345848A

United States Patent [19]

Knecht

[11] Patent Number: 5,345,848

[45] Date of Patent: Sep. 13, 1994

[54] CUTTER

[75] Inventor: Manfred Knecht, Bergatreute, Fed. Rep. of Germany

[73] Assignee: Knecht Maschinenbau GmbH, Bergatreute, Fed. Rep. of Germany

[21] Appl. No.: 952,713

[22] PCT Filed: Apr. 18, 1991

[86] PCT No.: PCT/DE91/00324

§ 371 Date: Nov. 13, 1992

§ 102(e) Date: Nov. 13, 1992

[87] PCT Pub. No.: WO91/17834

PCT Pub. Date: Nov. 28, 1991

[30] Foreign Application Priority Data

May 17, 1990 [DE] Fed. Rep. of Germany ..... 4015843

[51] Int. Cl.[5] ..... B26D 1/29

[52] U.S. Cl. ..... 83/663; 83/596

[58] Field of Search ..... 83/596, 595, 663, 591, 83/607; 241/292.1

[56] References Cited

U.S. PATENT DOCUMENTS 3,937,408 2/1976 Buck ..... 241/292.1

FOREIGN PATENT DOCUMENTS

| | | | |
|---|---|---|---|
| 0238953 | 9/1987 | European Pat. Off. . | |
| 0288024 | 10/1988 | European Pat. Off. . | |
| 1049260 | 1/1959 | Fed. Rep. of Germany . | |
| 1880229 | 11/1962 | Fed. Rep. of Germany . | |
| 1157957 | 11/1963 | Fed. Rep. of Germany . | |
| 1967090 | 6/1967 | Fed. Rep. of Germany . | |
| 2359539 | 6/1975 | Fed. Rep. of Germany | 241/292.1 |
| 3236978 | 4/1984 | Fed. Rep. of Germany | 241/292.1 |
| 16020 | 7/1927 | Netherlands | 241/292.1 |
| 115927 | 7/1926 | Switzerland | 241/292.1 |
| 466071 | 1/1969 | Switzerland . | |

*Primary Examiner*—Richard K. Seidel
*Assistant Examiner*—Kenneth E. Peterson
*Attorney, Agent, or Firm*—Spencer, Frank & Schneider

[57] ABSTRACT

A cutter which is particularly suitable for raw sausage production. Setting out from a knife with a knee and two circular cutting curves of equal radius and an outer edge concentric to the pivot, the base point of a perpendicular drawn from the knee onto the radial through the tip having a spacing from the pivot which is at least ¼ of the distance from the pivot to the tip, the special feature consists in the fact that the radials to the knee and to the tip enclose an angle of at least 60°. This results in a particularly broad knife blade.

3 Claims, 1 Drawing Sheet

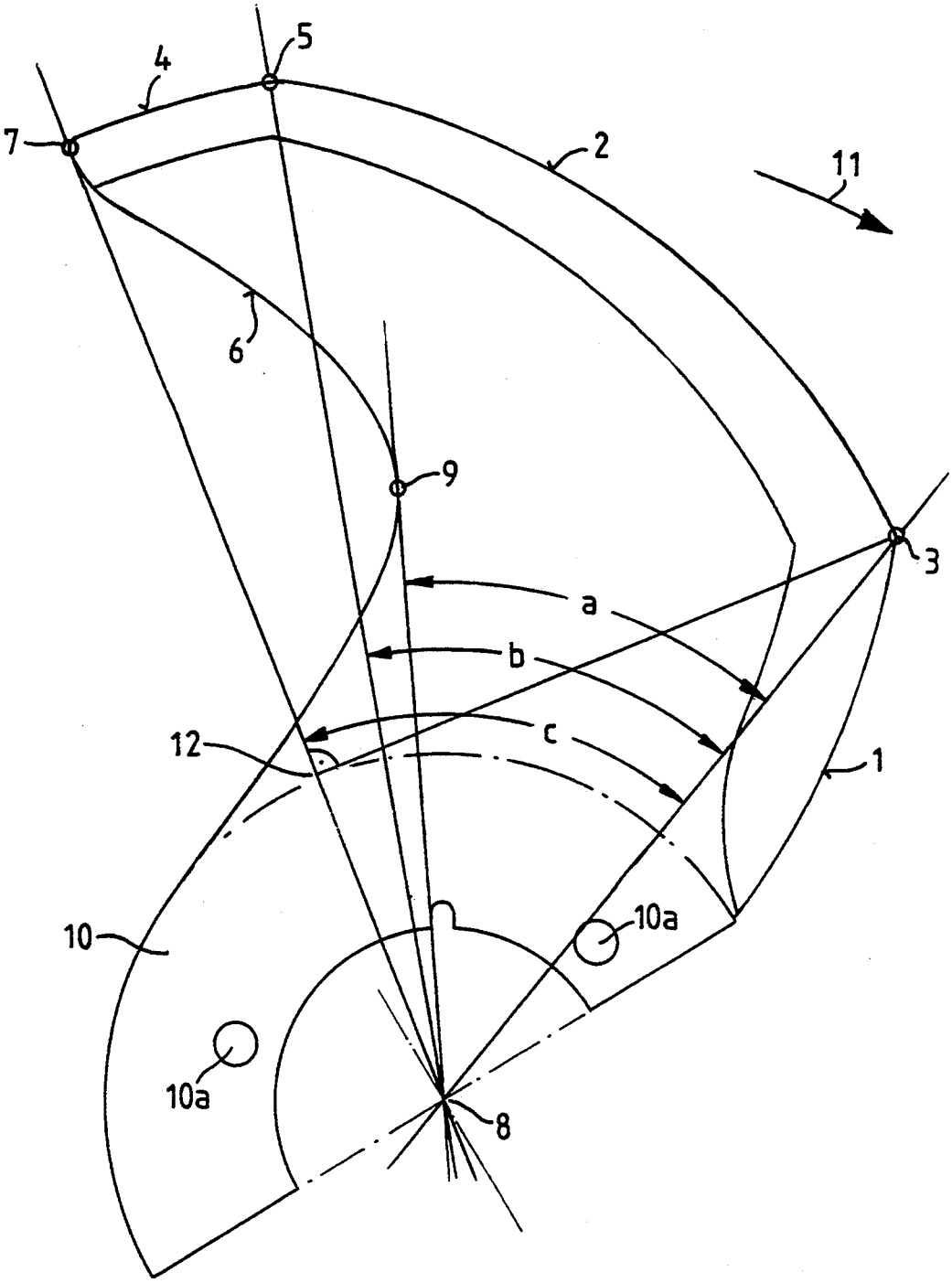
5
4
7
2
11
6
9
3
a
b
c
12
1
10
10a
10a
8

CUTTER

BACKGROUND OF THE INVENTION

The invention relates to a cutter that is rotatable in a circumferential direction and that has a axial point of rotation. The cutter includes a cutting edge that consists of first and second cutting portions, each having only a convex curve shape having equal radii, and adjoining one another to form one knee therebetween that projects in only a convex curve shape having equal radii, and adjoining one another to form one knee therebetween that projects in the circumferential direction. The cutter further includes an outer edge that is concentric to the axial point of rotation and adjoins the second portion to form a kink therebetween and being distal from the axial point of rotation. Further, a curved rear edge is provided that adjoins the outer edge to form a tip therebetween. The tip and the axial point of rotation define a first radial line, and the knee and the axial point of rotation define a second radial line. An imaginary line extending through the knee perpendicularly intersects the first radial line at a base point whose distance from the axial point of rotation is at least ¼ the distance between the axial point of rotation and the tip.

For cutting up meat for sausage production, so-called cutters are used which have an annular dish with a substantially semicircular cross-section. A cutter block which is mounted so as to be fixed in operation is arranged tangentially in the annular dish. A plurality of knives are attached to the cutter block at different angular positions and with mutual axial spacings. The cutter block is driven at a high rotational speed and, at the same time, the annular dish rotates about its vertical mid-axis so that the knives always act evenly on the meat.

A known cutter of the generic type is illustrated, for example, in the company brochure of the applicant, described as a "DELTA cutter system". It can be described in a rough approximation as sickle-shaped, but the cutting edge is located on the outside in contrast to a sickle. Accordingly, the direction of rotation is selected such that the cutting edge leads. The known knife serves mainly for producing fine sausage-meat, the intention being to cause an emulsifying effect whilst breaking down the protein molecules. According to experience gained in this application, the knife blade enters to a shallow extent, i.e. the knee is relatively blunt.

SUMMARY OF THE INVENTION

The invention is based on the object of proposing a cutter which is suitable to a particular extent for processing meat to produce raw sausage, the intention being to avoid any type of crushing and emulsifying.

This object is achieved by the invention setting out from a cutter of the generic type, in that the radials going from the axial point of rotation to the knee and to the tip enclose an angle of at least 60°. This measure results in a special contour of the knife which is recognizable at first sight by the broad knife blade.

The special feature of the mode of action of this knife consists in the fact that it enters—penetrates so to speak—the meat filling during rotation with the knee formed by the two cutting curves and, at least in the initial stage of the further cutting operation, the meat moves from the knee along the cutting curves toward opposite sides. The extended cutting curve, remote from the axis, also contributes substantially to the precise cutting characteristics achieved, as is desired especially for raw sausage.

Attempts have been made hitherto to reach a similar cutting result by knife shapes with particularly long sickle ends and by reducing the rotational speed of the cutter block, which, however, had to be achieved at the cost of a particularly high risk of breakage and a prolonged cutting time. However, it is particularly the latter which is undesirable since the temperature of the raw meat which is introduced into the cutter dish initially in a deep-frozen state rises rapidly. In contrast, when the proposed knives are used the cutting operation can be Completed in one or at most two minutes, the meat having a granular consistency with smooth cut faces.

The knife has the further advantage that it is resistant to fracture to a high degree. This is a result of the relatively great breadth and stability of the knife blade, i.e. of the region between the cutting curve near to the axis and the rear edge.

An exemplary embodiment of the invention is explained below with reference to the drawing in which a cutter for raw sausage production is illustrated.

DETAILED DESCRIPTION OF THE PREFERRED EMBODIMENT

The customary knife base 10 in the form of half an annular disk bears on one side two bolts 10*a* which engage in corresponding bores in the driving disk (not shown). The driving disks are mounted on the cutter block. The knife rotates in the direction of the arrow 11 about its axis. In the plan view shown, the knife axis appears as the axial point of rotation 8 or center-point of the knife base 10.

The front cutting edge is divided into a cutting curve 1 near to the axis and a cutting curve 2 remote from the axis, which cutting curves are circular and have equal radii. The two cutting curves together form a knee 3. At the substantially flatter trailing kink 5, the cutting curve 2 merges into the outer edge 4 which is circular relative to the pivot. The inside of the sickle is formed by the curved rear edge 6 which intersects the outer edge 4 in the tip 7 of the knife.

The position of the knee 3 is defined by the fact that a perpendicular is drawn from said knee onto the connecting line from the axial point of rotation 8 to the tip 7. The base point 12 of this perpendicular has a spacing from the axial point of rotation 8 of approximately ⅓ of the distance from the axial point of rotation 8 to the tip 7.

The most essential criterion of this knife is the angle c which the radials from the axial point of rotation 8 to the knee 3 on the one hand and to the tip 7 on the other hand enclose with one another. This angle, c, is 62° in the example.

Apart from the mentioned radial to the tip 7, the radials to the trailing kink 5 and to the curve apex 9 of the rear edge 6 are also significant. These radials enclose the angles b=50° and a=44° with the radial to the knee 3. It is advantageous for the desired cutting characteristics if these angles are also as large as possible.

We claim:

1. A cutter being rotatable in a circumferential direction about an axial point of rotation, comprising:

a cutting edge consisting of first and second cutting portions, said first and second cutting portion is each having only a convex curve shape having equal radii, said first and second cutting portions adjoining one another to form one knee therebetween projecting in the circumferential direction;

an outer edge concentric to the axial point of rotation and adjoining said second portion to from a kink therebetween, said kink being distal from the axial point of rotation; and a curved rear edge adjoining said outer edge to form a tip therebetween;

wherein said tip and said axial point of rotation define a first radial line, and said knee and said axial point of rotation define a second radial line, said first and second radial lines forming an angle of at least 60 degrees therebetween, and wherein an imaginary line extending through the knee perpendicularly intersects said first radial line at a base point whose distance from the axial point of rotation is at least $\frac{1}{4}$ the distance between the axial point of rotation and said tip.

2. A cutter as defined in claim 1, wherein said kink and said axial point of rotation define a third radial line, said second and third radial lines forming an angle of at least 45 degrees therebetween.

3. A cutter as defined in claim 1, wherein said curved rear edge has a curve apex, said curve apex and said axial point of rotation defining a third radial line, said second and third radial lines forming an angle of at least 40 degrees therebetween.

* * * * *